US005986537A

United States Patent [19]

Kato

[11] Patent Number: 5,986,537

[45] Date of Patent: Nov. 16, 1999

[54] HIGH-VOLTAGE VARIABLE RESISTOR

[75] Inventor: Shinji Kato, Fukui-ken, Japan

[73] Assignee: Murata Manufacturing Co., Ltd., Nagaokakyo, Japan

[21] Appl. No.: 08/869,343

[22] Filed: Jun. 5, 1997

[30] Foreign Application Priority Data

Jun. 5, 1996 [JP] Japan ..... 8-143114
Jun. 19, 1996 [JP] Japan ..... 8-158152

[51] Int. Cl.[6] ..... H01C 10/00

[52] U.S. Cl. ..... 338/68; 338/160; 338/162; 338/118; 338/167

[58] Field of Search ..... 338/160, 162, 338/118, 174, 128

[56] References Cited

U.S. PATENT DOCUMENTS 5,508,678 4/1996 Tsunezawa et al. ..... 338/160
5,532,669 7/1996 Tsunezawa et al. ..... 338/184

*Primary Examiner*—Michael L. Gellner
*Assistant Examiner*—Richard K. Lee
*Attorney, Agent, or Firm*—Burns, Doane, Swecker & Mathis, LLp

[57] ABSTRACT

A high-voltage variable resistor includes an insulating substrate having a surface on which there is formed a resistor including a variable resistor portion and a plurality of terminal electrodes including an output terminal electrode. A rotation shaft is included which is equipped with a sliding member adapted to slide on the variable resistor portion of the resistor when the rotation shaft is rotated. An insulating case rotationally supports the rotation shaft. The insulating substrate is disposed in the case such that the aforementioned surface is opposed to an inner bottom portion of the case. A capacitor connecting terminal is inserted through the insulating substrate and is electrically connected to the output terminal electrode. A connection terminal member is provided which has a spring portion electrically connected to the capacitor connecting terminal, and holding members for holding an output line inserted in the insulating case, wherein the connection terminal member connects the output terminal electrode to the output line without performing soldering. Finally, a capacitor is arranged on a back side of the insulating substrate and is connected to the capacitor connecting terminal. The above structure allows the high-voltage variable resistor to be formed reduced in size, and makes it possible to standardize the connection terminal member. Further aspects of the invention comprise a conductive rubber member for forming an electrical connection between the capacitor connecting terminal and the connection terminal member. In the another aspect of the invention, the capacitor connecting terminal has a fixation flange for attaching the capacitor connecting terminal with the substrate, and a contact flange for providing a contact surface for contact with the spring portion of the connection terminal member.

10 Claims, 4 Drawing Sheets

Fig. 3
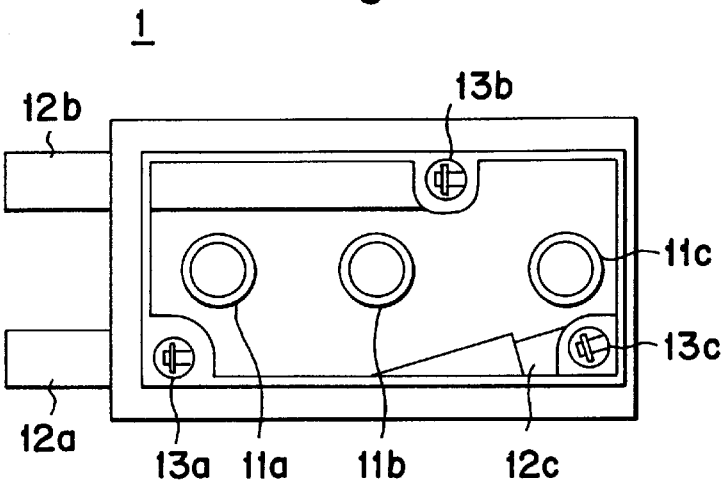
Fig. 4
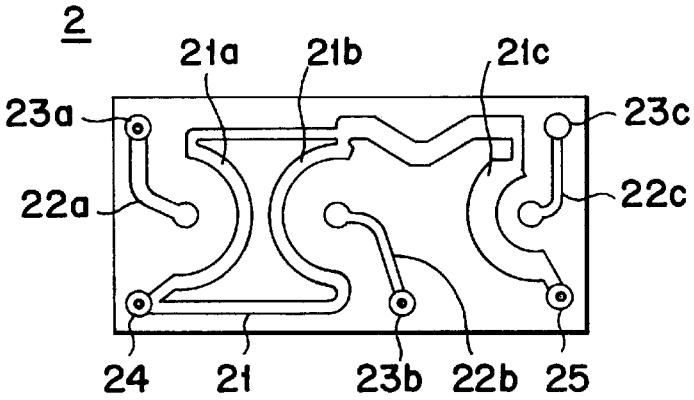
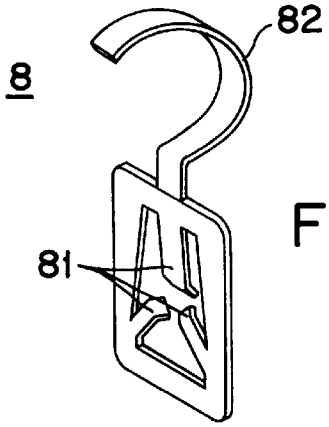
Fig. 5

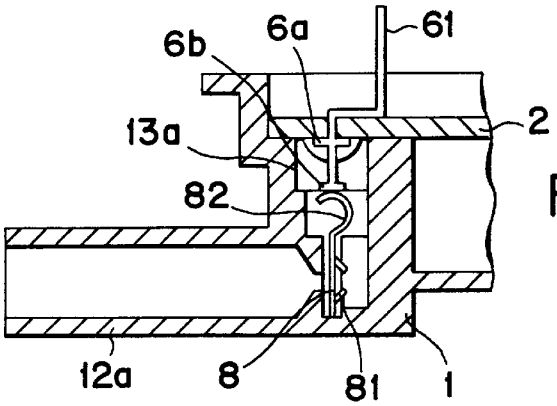
Fig. 7
Fig. 6
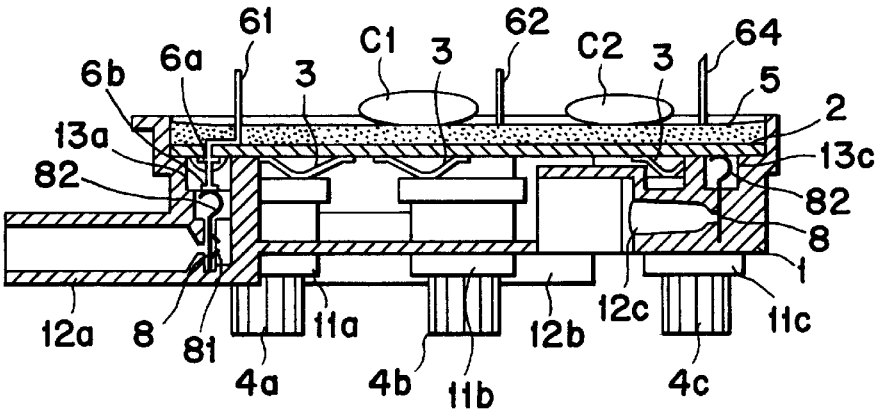
Fig. 8
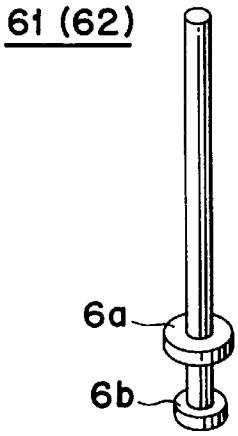
Fig. 9
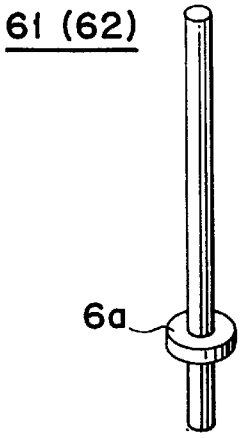

HIGH-VOLTAGE VARIABLE RESISTOR

This application corresponds to Japanese Patent Application Nos. 8-143114 and 8-158152, filed on Jun. 5, 1996 and Jun. 19, 1996, respectively, both of which are hereby incorporated by reference in their entirety.

BACKGROUND OF THE INVENTION

1. Field of the Invention

The present invention relates to a high-voltage variable resistor used to adjust the focus voltage, screen voltage, etc. of a television receiver or like device.

2. Description of the Related Art

In a high-voltage variable resistor used to adjust the focus voltage, screen voltage, etc. of a television receiver, a capacitor called a dynamic focus capacitor for filtering or signal voltage coupling may be connected between a focus voltage output electrode and a grounding electrode or between the output electrode and a signal input terminal.

In a conventional high-voltage variable resistor, such a capacitor is arranged on the back side of an insulating substrate which is disposed in an insulating case having one side open. The resistor device includes a connection terminal member having a spring portion and holding members. The holding members secure a core wire of an inserted output line. A part of the spring portion is brought into press contact with an output electrode formed on the surface of the insulating substrate, whereby it is possible to connect the output electrode and the output line to each other without performing soldering using the connection terminal member.

FIG. 10 is a sectional view showing principal components of a focus voltage output section connecting structure of such a conventional high-voltage variable resistor. As shown in FIG. 10, an insulating substrate 2 is disposed in and fixed to an insulating case 1 with one side open, and a connecting member accommodating section 13 is provided at the base of a cylindrical output line holding section 12 which is provided on the insulating case 1.

In the connecting member accommodating section 13, a connection terminal member 8 is disposed and fixed such that a spring portion 82 thereof is brought into press contact with a focus voltage output terminal electrode (not shown) formed on the surface of the insulating substrate 2. A capacitor connecting terminal 6 is inserted from the back side of the insulating substrate 2 and is soldered to the output terminal electrode and thereby connected to the output terminal electrode. A capacitor is connected to the capacitor connecting terminal 6.

An output line for extracting focus voltage is inserted into the output line holding section 12, and the core wire of the output line is held by a plurality of holding members 81 formed on the connection terminal member 8.

However, in the above-described conventional high-voltage variable resistor, a section for soldering the capacitor connecting terminal 6 and a laterally displaced section for forming a contact with the connection terminal section 8 are necessary, so that it is necessary to form the output terminal electrode having a large size and to allocate the required space inside the connecting member accommodating section 13 for both of the above-mentioned connections inside the insulating case 1. This results in the size of the entire high-voltage variable resistor becoming rather large.

Further, when the distance between the output line holding section 12 and the surface of the insulating substrate 2 is varied, it is necessary to provide connection terminal members 8 of a variety of sizes corresponding to the variation.

SUMMARY OF THE INVENTION

It is accordingly exemplary objects of the present invention to provide a high-voltage variable resistor which can be reduced in size, which promotes the standardization in the size of the connection terminal member and which makes it possible to attain stable and reliable connections.

To achieve the above objects, there is provided, in accordance with a first exemplary aspect of the present invention, a high-voltage variable resistor comprising: (a) an insulating substrate having a surface on which there is formed a resistor including a variable resistor portion and a plurality of terminal electrodes including an output terminal electrode; (b) a rotation shaft equipped with a sliding member adapted to slide on the variable resistor portion of the resistor when the rotation shaft is rotated; (c) an insulating case with one side open which rotationally supports the above-mentioned rotation shaft and in which the insulating substrate is disposed and fixed such that the above-mentioned surface is opposed to an inner bottom portion of the case; (d) a capacitor connecting terminal arranged so as to be inserted through the above-mentioned insulating substrate and electrically connected to the above-mentioned output terminal electrode; (e) a connection terminal member which has a spring portion electrically connected to the above-mentioned capacitor connecting terminal, and which has holding members for holding an inserted output line, which is accommodated in the above-mentioned insulating case and which connects the output terminal electrode to the output line without performing soldering; and (f) a capacitor which is arranged on a back side of the above-mentioned insulating substrate and which is connected to the above-mentioned capacitor connecting terminal.

In accordance with a second exemplary aspect of the present invention, there is provided a high-voltage variable resistor comprising: (a) an insulating substrate having a surface on which there is formed a resistor including a variable resistor portion and a plurality of terminal electrodes including an output terminal electrode; (b) a rotation shaft equipped with a sliding member adapted to slide on the variable resistor portion of the film resistor when the rotation shaft is rotated; (c) an insulating case with one side open which rotationally supports the above-mentioned rotation shaft and in which the insulating substrate is disposed and fixed such that the above-mentioned surface is opposed to the inner bottom portion of the case; (d) a conductive resilient (e.g. rubber) member disposed in the above-mentioned insulating case and arranged so as to be held in close contact with the above-mentioned output terminal electrode; (e) a capacitor connecting terminal inserted into the above-mentioned conductive rubber member through the insulating substrate from the back side of the above-mentioned insulating substrate; (f) a connection terminal member which has a spring portion which is held in press contact with the above-mentioned rubber member, and also includes holding members for holding an inserted output line which is accommodated in the above-mentioned insulating case; and (f) a capacitor which is arranged on the back side of the above-mentioned insulating substrate and which is connected to the above-mentioned capacitor connecting terminal.

In accordance with a third exemplary aspect of the present invention, there is provided a high-voltage variable resistor comprising: (a) an insulating substrate having a surface on which there is formed a resistor including a variable resistor portion and a plurality of terminal electrodes including an output terminal electrode; (b) a rotation shaft equipped with a sliding member adapted to slide on the variable resistor portion of the film resistor when the rotation shaft is rotated; (c) an insulating case with one side open which rotationally supports the above-mentioned rotation shaft and in which the insulating substrate is disposed and fixed such that the above-mentioned surface is opposed to the inner bottom portion of the case; (d) a capacitor connecting terminal which is arranged so as to be passed through the above-mentioned insulating substrate, which has a fixation flange portion at a predetermined position on said capacitor connecting terminal, wherein the fixation flange portion is attached (e.g. by solder) to the output terminal electrode of the substrate so as to be in close contact therewith; (e) a connection terminal member which has a spring portion held in press contact with a forward end portion of the capacitor connecting terminal, and holding members for holding an inserted output line which is accommodated in the insulating case; and (f) a capacitor which is arranged on a back side of the insulating substrate and which is connected to the capacitor connecting terminal.

According to a fourth exemplary aspect of the present invention, in the high-voltage variable resistor according to the above-described third aspect, there is formed at the forward end of the above-mentioned capacitor connecting terminal a contact flange portion with which the spring portion of the above-mentioned connection terminal member is held in press contact.

In the above-described construction, the connection terminal member can be connected to the capacitor connecting terminal directly by press contact or through the intermediation of a conductive rubber member without performing soldering, and it is possible for the connection terminal member and the connecting section of the capacitor connecting terminal to be arranged at the same or at a similar position of the insulating substrate. Thus, it is possible to reduce the size of the insulating substrate and effectively utilize the inner space of the insulating case, so that it is possible to achieve a reduction in the overall size of the high-voltage variable resistor.

Further, when the connection terminal member and the capacitor connecting terminal are directly held in contact with each other, a fixation flange portion is provided on the capacitor connecting terminal, and this flange portion is pressed against the output terminal electrode formed on the insulating substrate, whereby it is possible to accurately effect the positioning of the capacitor connecting terminal in the direction perpendicular to the insulating substrate by selecting the position of the fixation flange on the capacitor connecting terminal. That is, the forward end of the capacitor connecting terminal can be reliably disposed such that the distance from the forward end to the surface of the insulating substrate can be kept constant, thereby making it possible to achieve a stable and reliable contact connection with the spring portion of the connection terminal member.

Further, by varying the length of the conductive rubber member or the position at which the above-mentioned fixation flange portion is formed, it is possible to achieve a reliable contact connection with a contact terminal member having a fixed size. Thus, it is not necessary to provide a variety of connection terminal members of different sizes. Rather, it is possible to effect a standardization of the connection terminal member size. Since the connection terminal member is formed using a relatively expensive mold, the above-described standardization achieves a reduction in mold cost and thus reduces the cost of the connection terminal member.

Further, when the connection terminal member and the capacitor connecting terminal are directly brought into contact with each other, a contact flange portion is provided at the forward end of the capacitor connecting terminal to thereby enlarge the area of contact with the spring portion of the connection terminal member, thereby making it possible to achieve a more stable and more reliable contact connection.

Further, since it is possible to reliably establish an electrical connection between the output terminal electrode, the connection terminal member and the capacitor connecting terminal with reduced soldered sections or without performing any soldering, it is possible to reduce or eliminate the cumbersome processing and operations involved in soldering, thereby achieving a reduction in production cost.

BRIEF DESCRIPTION OF THE DRAWINGS

The foregoing, and other, objects, features and advantages of the present invention will be more readily understood upon reading the following detailed description in conjunction with the drawings in which:

FIG. 1(*b*) is a front view of the high-voltage variable resistor of the first embodiment;

FIG. 1(*c*) is a rear view of the high-voltage variable resistor of the first embodiment;

FIG. 3 is a rear view of an insulating case according to the first embodiment of the present invention;

FIG. 4 is a plan view showing the surface of an insulating substrate according to the first embodiment of the present invention;

FIG. 5 is a perspective view of a connection terminal member according to the first embodiment of the present invention;

FIG. 6 is a sectional view of a second embodiment of the present invention;

FIG. 7 is a sectional view of the principal components of a high-voltage output section of a high-voltage variable resistor according to the second embodiment of the present invention;

FIG. 8 is a perspective view of a capacitor connecting terminal according to the second embodiment of the present invention;

FIG. 9 is a perspective view of a capacitor connecting terminal according to another embodiment of the present invention.

DESCRIPTION OF THE PREFERRED EMBODIMENTS

Figure 1A:
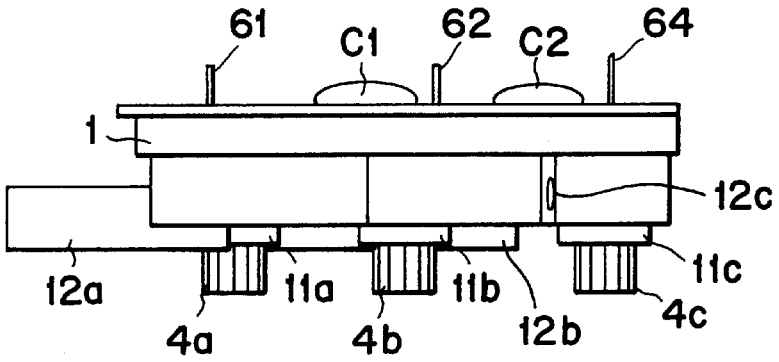
FIG. 1(*a*) is a side view of a high-voltage variable resistor according to a first embodiment of the present invention.
Figure 1B:
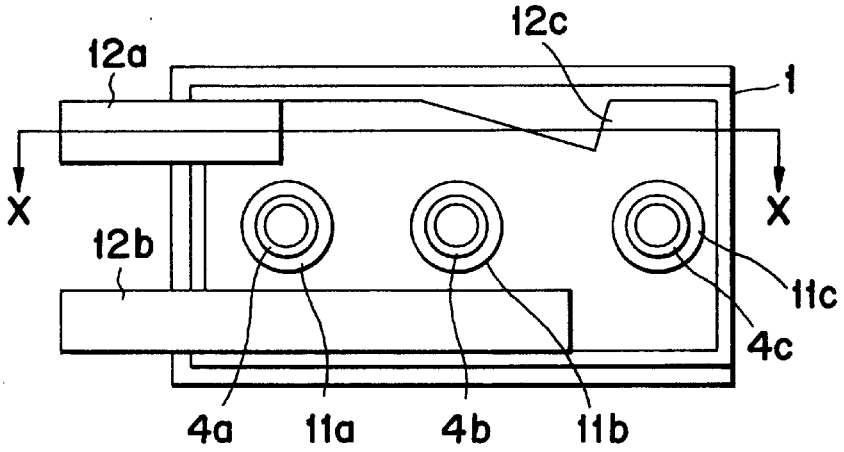
Figure 1C:
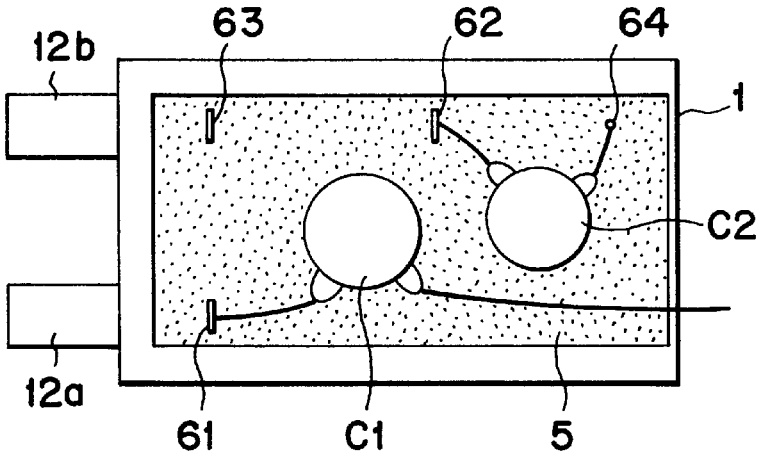
Figure 2:
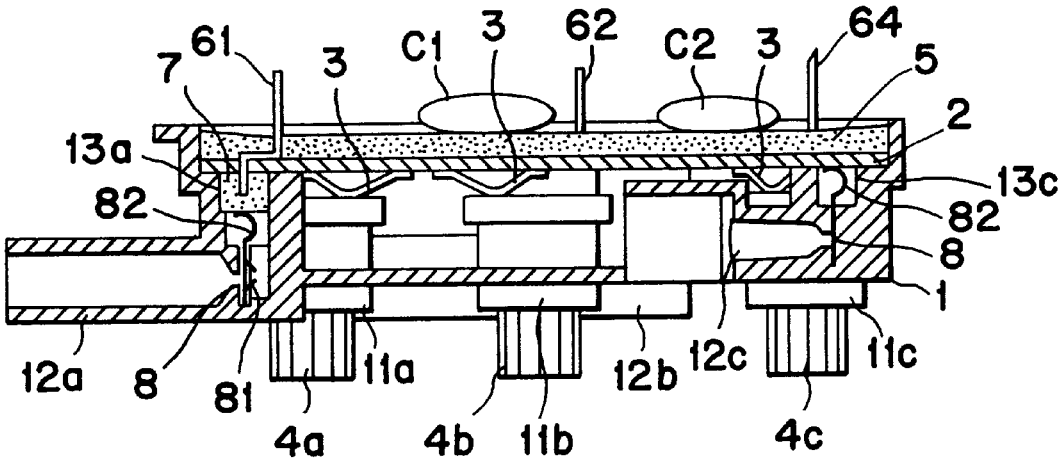
FIG. 2 is a sectional view of the high-voltage variable resistor of the first embodiment of the present invention, taken along the line X—X of FIG. 1(*b*)
Figure 10:
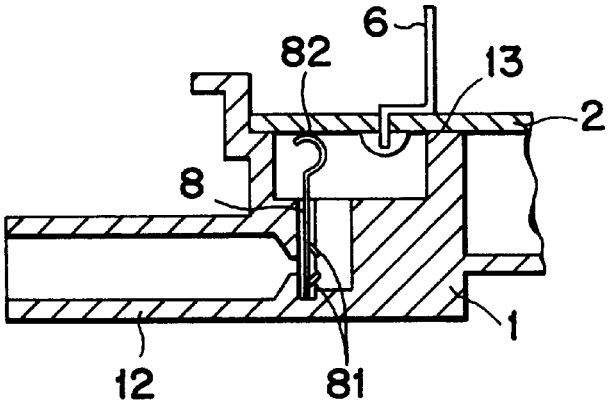
FIG. 10 is a sectional view of the principal components of a connection structure of a high-voltage output section of a conventional high-voltage variable resistor.

A high-voltage variable resistor according to a first embodiment of the present invention will now be described with reference to FIGS. 1 through 5. FIG. 1(*a*) is a side view of the high-voltage variable resistor of the first embodiment. FIG. 1(*b*) is a front view of the high-voltage variable resistor, and FIG. 1(*c*) is a rear view thereof. FIG. 2 is a sectional view taken along the line X—X of FIG. 1(*b*). FIG. 3 is a rear view of an insulating case of the high-voltage variable resistor of the first embodiment. FIG. 4 is a plan view showing the surface of an insulating substrate of the high-voltage variable resistor of the first embodiment. And finally, FIG. 5 is a perspective view of a connection terminal member of the high-voltage variable resistor of the first embodiment. In FIGS. 1(*a*) and 2, the lead terminal of the capacitor is omitted for clarity of the figures.

The high-voltage variable resistor of this embodiment is a so-called double-focus type, which outputs two kinds of focus voltages and one kind of screen voltage. As shown in FIGS. 1 through 4, an insulating substrate 2 formed of alumina or the like is glued and fixed to a step section formed in an inner periphery of the insulating case 1 so that one side is open. Rotation shafts 4*a*, 4*b* and 4*c* to which sliding members 3 are mounted are rotationally supported by cylindrical bearing portions 11*a*, 11*b* and 11*c* provided in the front portion of the insulating case 1. On the back side of the insulating substrate 2, capacitor connecting terminals 61 and 62, a high-voltage input terminal 63 and a grounding terminal 64 extend out therefrom. Capacitors C1 and C2 are connected to these predetermined terminals as will be described in further detail below. Furthermore, a coating of an epoxy type resin 5 or like material is formed by a molding process on the back side of the insulating substrate 2 (however, the resin is omitted in FIG. 3 for clarity of illustration).

Output line holding portions 12*a*, 12*b* and 12*c* are integrally formed in the insulating case 1. As shown in FIG. 3, connection member accommodating sections 13*a*, 13*b* and 13*c*, surrounded by segregation walls, are provided at the base of the output line holding sections 12*a*, 12*b* and 12*c*.

As shown in FIG. 4, on the surface of the insulating substrate 2, there are formed resistors 21 including variable resistor portions 21*a* and 21*b* for adjusting the first and second focus voltages and a variable resistor portion 21*c* for adjusting the screen voltage. The substrate 2 further comprises output electrodes 22*a* and 22*b* for the first and second focus voltages, and an output electrode 22*c* for the screen voltage. Output terminal electrodes 23*a*, 23*b* and 23*c* are electrically connected to the output electrodes 22*a*, 22*b* and 22*c*, respectively, and an input terminal electrode 24 and a grounding terminal electrode 25 are electrically connected to the resistors 21. Substantially at the center of the terminal electrodes 23*a*, 23*b*, 24 and 25, there are formed through-holes for connecting terminals 61, 62, 63 and 64 to the terminal electrodes 23*a*, 23*b*, 24 and 25, respectively, and for allowing the above-identified connecting terminals to pass through the through-holes. The above electrodes are formed of a conductive electrode material or a material which forms a resistor.

Each of the sliding members 3 is arranged such that one end thereof slides on the corresponding arcuate variable resistors 21*a*, 21*b*, 21*c* when the respective rotation shafts 4*a*, 4*b* and 4*c* are rotated.

In the connection member accommodating section 13*a* of the insulating case 1, a conductive rubber member 7 is provided (e.g. comprising a polymer with conductive material dispersed therein, or generally comprising any resilient conductive material). The conductive rubber member 7 is disposed so as to be held in press contact with the output terminal electrode 23*a* formed on the surface of the insulating substrate 2, and a connection terminal member 8 is disposed such that a spring portion 82 thereof is held in press contact with the conductive rubber member 7. The capacitor connecting terminal 61 is inserted into this conductive rubber member 7 from the back side of the insulating substrate 2. That is, the conductive rubber member 7 is disposed such that one side thereof is held in contact with the output terminal electrode 23*a* of the substrate 2 and the other side thereof is held in contact with the connection terminal member 8. Also, one end of the capacitor connecting terminal 61 is connected to the conductive rubber member 7 and the other end thereof protrudes from the back side of the insulating substrate 2 beyond the resin 5.

Another connection terminal member 8 is disposed in and fixed to the connection member accommodating section 13*c* such that a spring portion 82 thereof is held in press contact with the output terminal electrode 23*c* for the screen voltage.

Further, although not shown, as in the connection member accommodating section 13*a*, another conductive rubber member 7 is accommodated in the connection member accommodating section 13*b* so as to be held in contact with the output terminal electrode 23*b* and another connection terminal member 8. A capacitor connecting terminal 62 is inserted into this conductive rubber member 7 from the back side of the insulating substrate 2.

The input terminal 63 and the grounding terminal 64 are connected to the input terminal electrode 24 and the grounding terminal electrode 25, respectively, by soldering or other bonding technique. Alternatively, conductive rubber member accommodating sections for the input terminal 63 and the grounding terminal 64 may be provided in the insulating case 1, which connect the input terminal 24 and the grounding terminal 25 to the terminal electrodes 63 and 64, respectively. In this case, the requisite electrical connections can be achieved without performing soldering.

The capacitor C1 is a capacitor for dynamic focus signal coupling. One lead terminal of the capacitor C1 is connected to the capacitor connecting terminal 61, and the other lead terminal thereof is connected to a parabola waveform signal terminal (not shown). The capacitor C2 is a filter capacitor. One lead terminal of the capacitor C2 is connected to the capacitor connecting terminal 62, and the other lead terminal thereof is connected to the grounding terminal 64 (as best shown in FIG. 1(*c*)).

While, in this embodiment, the capacitors C1 and C2 are mounted after the filling and curing of the resin 5, it is also possible to fill in the resin 5 after mounting the capacitors C1 and C2.

The connection terminal member 8 is formed by punching out the member 8 from a flat metal plate. As shown in FIG. 5, the member 8 is equipped with a plurality of holding members 81 for resiliently holding the core wire of the output line. The member 8 also includes a spring portion 82 bent into a curved spring-like form.

Output lines for extracting the first and second focus voltages are inserted into the output line holding sections 12*a* and 12*b*, respectively, and an output line for extracting the screen voltage is inserted into the output line holding section 12*c*. The core wires of the inserted output lines are held by the holding members 81 of the connection terminal members 8 by applying a pinching force to the core wires, so that the output lines are prevented from being detached from the output line holding sections 12*a*, 12*b* and 12*c*.

As described above, in the high-voltage variable resistor of the first embodiment, the conductive rubber members 7 are disposed such that they are respectively connected to the output terminal electrodes 23*a* and 23*b* for outputting the first and second focus voltages. The connection terminal members 8 and the capacitor connecting terminals 61 and 62 are arranged at the same or at a similar position, such that the connecting terminals 61 and 62 are, in effect, on top of the connection terminal members 8, and connected thereto via the conductive rubber members 7. This configuration, as compared to the conventional high-voltage variable resistors, allows the size of the output terminal electrodes 23*a* and 23*b* to be reduced, thereby achieving a consequent reduction in the size of the insulating substrate 2 and of the insulating case 1.

Further, even when the mounting height (generally the distance from the substrate 2 to the corresponding output line holding section 12) of the insulating substrate 2 differs, a reliable contact connection can be achieved with a connection terminal member 8 of a fixed size simply by varying the length of the conductive rubber member 7. Thus, it is possible to standardize the connection terminal member 8, thereby making it possible to achieve a reduction in mold cost and the cost of the connection terminal member 8.

Further, the output terminal electrode (e.g. 23*a*, 23*b*), the connection terminal member 8, and the capacitor connecting terminal (e.g. 61, 62) are reliably electrically connected without performing soldering. Further, the electrodes of the insulating substrate 2 and the terminals (e.g. 63, 64) can be connected without performing soldering. That is, there is no need to perform the cumbersome processing operations involved in soldering, such as efforts directed at preventing the inadvertent removal of solder while soldering, and cleaning operations (for instance, to remove excess solder).

Next, a high-voltage variable resistor according to the second embodiment of the present invention will be described with reference to FIGS. 6 through 8. FIG. 6 is a sectional view of the high-voltage variable resistor according to the second embodiment. FIG. 7 is a sectional view of principal components of the high-voltage output section of the high-voltage variable resistor according to the second embodiment, and FIG. 8 is a perspective view of a capacitor connecting terminal for use in the second embodiment. In FIGS. 6 and 7, the lead terminals of the capacitors are omitted for clarity of the figures.

As shown in FIGS. 6 and 7, in the high-voltage variable resistor of this embodiment, the connection terminal member 8 is inserted in the connection member accommodating section 13*a* at the base portion of the output line holding section 12*a* of the insulating case 1. The capacitor connecting terminal 61 includes a flange portion 6*a* (henceforth referred to as the "fixation flange portion") which is fixed and soldered to the output terminal electrode 23*a* formed on the surface of the insulating substrate 2. The connection terminal member 8 is disposed and fixed such that the spring portion 82 thereof is held in press contact with a flange portion 6*b* (henceforth referred to as the "contact flange portion") for providing electrical contact with the capacitor connecting terminal 61. That is, one end of the capacitor connecting terminal 61 is connected so as to be held in contact with the connection terminal member 8, and the other end thereof is arranged so as to protrude from the back side of the insulating substrate 2 beyond the resin 5.

Further, although not shown, as in the connection member accommodating section 13*a*, in the connection member accommodating section at the base portion of the output line holding section 12*b*, there is arranged a capacitor connecting terminal 62 with a flange portion 6*a* for fixing the terminal 62 with respect to the substrate 2, and a flange portion 6*b* for providing press contact with the connection terminal member 8. Apart from the above, the second embodiment has the same construction as that of the first embodiment, so a further description thereof will be omitted.

The capacitor connecting terminals 61 and 62 are formed by cutting a linear conductor having a round cross-sectional configuration in a predetermined length. As shown in FIG. 8, the capacitor connecting terminals 61, 62 are equipped with two disc-like flange portions, including the flange portion 6*a* (the fixation flange portion) for fixing the terminals with respect to the substrate 2 and the flange portion 6*b* (the contact flange portion) for providing contact with the connection terminal members 8. The contact flange portion 6*b* is provided on the forward end of the terminals, and the fixation flange portion 6*a* is spaced apart from the contact flange portion 6*b* by a predetermined distance. The fixation flange portion 6*a* and the contact flange portion 6*b* are formed by header machining or like formation technique, or can be molded.

The fixation flange portion 6*a* is provided for the purpose of accurately determining the vertical positioning of the capacitor connecting terminals 61 and 62 (e.g. how far the terminals 61, 62 extend past the substrate 2), and the contact flange portion 6*b* is provided for the purpose of achieving a stable and reliable contact with the spring portion 82 of the connection terminal member 8 by enlarging the area at the forward end surface. The distance between the fixation flange portion 6*a* and the contact flange portion 6*b*, that is, the position at which the fixation flange portion 6*a* is formed, is appropriately set according to the size (e.g. length) of the connection terminal member 8 and the mounting height of the insulating substrate 2 (e.g. the distance between the substrate 2 and output line holding section 12).

The capacitor connecting terminals 61 and 62 are inserted into through-holes provided substantially at the center of the output terminal electrodes 23*a* and 23*b* for outputting the focus electrode voltages of the insulating substrate 2 from the front side of the insulating substrate 2. Then, the terminals 61 and 62 are advanced until their respective flange portions 6*a* come into close contact with respective output terminal electrodes 23*a*, 23*b*, and then the flange portions 6*a* are soldering to the electrodes 23*a*, 23*b*. This process causes some bending on the back side of the insulating substrate 2.

As described above, in the high-voltage variable resistor of the second embodiment, the connection terminal member 8 and the capacitor connecting terminals 61 and 62 are arranged at the same or at a similar position and connected, so that, as compared to the conventional high-voltage variable resistors, the corresponding output terminal electrode (e.g. 23*a* and 23*b*) can be formed of a smaller size (e.g. a smaller length), thereby achieving a reduction in the size of the insulating substrate 2 and of the insulating case 1.

Further, even when the mounting height of the insulating substrate 2 differs, the flange portion 6*b* for contacting the member 8 can be arranged at a desired position by varying the position at which the fixation flange portion 6*a* is formed. It is thus possible to achieve a reliable contact connection with a contact terminal member 8 having a fixed size. Thus, it is possible to standardize the connection terminal member 8, thereby achieving a reduction in mold cost and the cost of the connection terminal member 8.

The flange portion 6*b* for contacting the member 8 provided at the forward end of the capacitor connecting terminal (e.g. 61 or 62) can be omitted. Specifically, as shown in FIG. 9, it is also possible to equip the capacitor connecting terminals 61 and 62 only with the fixation flange portion 6*a*. Even in the case in which the capacitor connecting terminal (e.g. 61, 62) as shown in FIG. 9 is used, it is possible to achieve a stable connection when a flat and wide contact section is formed on the spring portion 82 of the connection terminal member 8.

Further, although the above embodiments have been described with respect to a high-voltage variable resistor which outputs two types of focus voltages and one type of screen voltage, this is only illustrative and should not be construed as restricting the invention. The present invention is also applicable to a high-voltage variable resistor which outputs at least one type of focus voltage or screen voltage, as well as to other types of electronic components.

Further, the details provided regarding the wiring, connection, etc. of the capacitors is illustrative and not restrictive. The wiring, connection, etc. can be appropriately modified in accordance with the requisite characteristics of different applications.

As described above, in the high-voltage variable resistor of the present invention, the connection terminal member and the connecting section of the capacitor connecting terminal can be arranged at the same or at a similar position in a direction parallel to the surface of the insulating substrate, so that it is possible to reduce the size of the insulating substrate and effectively utilize the inner space of the insulating case, thereby achieving a reduction in size of the unit.

Further, a fixation flange portion is provided on the capacitor connecting terminal, and can be reliably arranged such that the forward end of the connecting terminal is spaced apart from the surface of the insulating substrate by a fixed distance, thereby making it possible to achieve a stable contact connection with the spring portion of the connection terminal member. Further, by providing a flange portion for contact at the forward end of the capacitor connecting terminal, it is possible to achieve a more stable and more reliable contact connection with the connection member.

Further, by varying the position at which the fixation flange portion is formed and the length of the conductive rubber member, it is possible to achieve a reliable contact connection with a connection terminal member of a fixed size, so that the connection terminal member can be standardized, thereby achieving a reduction in mold cost and the cost of the connection terminal member.

Further, since it is possible to reliably effect an electrical connection between the output terminal electrode, the connection terminal member and the capacitor connecting terminal without performing soldering, it is possible to eliminate the cumbersome processing and operations involved in soldering, thereby achieving a reduction in production cost.

In summary, the above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims.

What is claimed is:

1. A high-voltage variable resistor comprising:

an insulating substrate having a surface on which there is formed a resistor including a variable resistor portion and a plurality of terminal electrodes including an output terminal electrode;

a rotation shaft equipped with a sliding member adapted to slide on the variable resistor portion of the resistor when the rotation shaft is rotated;

an insulating case with one side open which rotationally supports said rotation shaft and in which the insulating substrate is disposed such that said surface is opposed to an inner bottom portion of said case;

a capacitor connecting terminal arranged so as to be inserted through said insulating substrate and electrically connected to said output terminal electrode;

a connection terminal member which has a spring portion electrically connected to said capacitor connecting terminal, and holding members for holding an output line inserted in said insulating case, wherein said connection terminal member is disposed directly beneath a portion of said capacitor connecting terminal; and a capacitor which is arranged on a back side of said insulating substrate and which is connected to said capacitor connecting terminal.

2. A high-voltage variable resistor of claim 1, further including:

a conductive resilient member disposed in said insulating case and arranged so as to be held in close contact with said output terminal electrode;

wherein said capacitor connecting terminal is inserted into said conductive resilient member through the insulating substrate from a back side of said insulating substrate;

wherein said connection terminal member's spring portion is held in press contact with said resilient member.

3. A high-voltage variable resistor of claim 1, further wherein:

said capacitor connecting terminal has a fixation flange portion at a predetermined position on said connecting terminal, wherein said fixation flange portion is attached to said output terminal of said substrate so as to be in close contact therewith; and said connection terminal member's spring portion is held in press contact with a forward end portion of said capacitor connecting terminal.

4. A high-voltage variable resistor as claimed in claim 3, wherein there is formed at the forward end of said capacitor connecting terminal a contact flange portion with which the spring portion of said connection terminal member is held in press contact.

5. A high-voltage variable resistor as claimed in claim 2, wherein said conductive resilient material comprises conductive rubber.

6. A high-voltage variable resistor as claimed in claim 3, wherein said fixation flange portion is connected to said substrate by solder.

7. A high-voltage variable resistor of claim 1, wherein said connection terminal member is electrically connected to the capacitor connecting terminal without performing soldering.

8. A high-voltage variable resistor as claimed in claim 1, wherein a top portion of said spring portion is vertically aligned with said capacitor connecting terminal.

9. A high-voltage variable resistor as claimed in claim 2, wherein a top portion of said spring portion which contacts said resilient member is vertically aligned with a portion of said capacitor connecting terminal which is inserted in said resilient member.

10. A high-voltage variable resistor as claimed in claim 1, wherein said spring member has a curved spring-like form.

* * * * *